US010843461B2

(12) United States Patent
Kobayashi

(10) Patent No.: US 10,843,461 B2
(45) Date of Patent: Nov. 24, 2020

(54) HEAD HOLDING MECHANISM AND INKJET PRINTER

(71) Applicant: MIMAKI ENGINEERING CO., LTD., Nagano (JP)

(72) Inventor: Hiroshi Kobayashi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/392,601

(22) Filed: Apr. 23, 2019

(65) Prior Publication Data

US 2019/0329574 A1 Oct. 31, 2019

(30) Foreign Application Priority Data

Apr. 27, 2018 (JP) ..... 2018-086862

(51) Int. Cl.
*B41J 2/14* (2006.01)
*B41J 25/34* (2006.01)

(52) U.S. Cl.
CPC ..... *B41J 2/14024* (2013.01); *B41J 2/14* (2013.01); *B41J 25/34* (2013.01)

(58) Field of Classification Search
CPC . B41J 2/14024; B41J 2/145; B41J 2/15; B41J 2/155; B41J 2/175; B41J 2/17503; B41J 2202/20; B41J 2202/21
See application file for complete search history.

(56) References Cited

U.S. PATENT DOCUMENTS

2014/0168319 A1* 6/2014 Moreau et al. ..... B41J 2/145

FOREIGN PATENT DOCUMENTS

JP 2016215421 12/2016

* cited by examiner

*Primary Examiner* — Juanita D Jackson
(74) *Attorney, Agent, or Firm* — JCIPRNET

(57) ABSTRACT

A head holding mechanism and an inkjet printer are provided. The head holding mechanism includes a head holding member that holds an inkjet head, a carriage side member attached to the carriage and to which the head holding member is fixed, and a fixing member for fixing the head holding member to the carriage side member. The fixing member is movably held by the carriage side member. The fixing member is movable between an engagement position where the fixing member engages with the head holding member to fix the head holding member to the carriage side member, and a disengagement position where the engagement state of the head holding member and the fixing member is released and the head holding member is detachable from the carriage side member.

12 Claims, 8 Drawing Sheets

HEAD HOLDING MECHANISM AND INKJET PRINTER

CROSS REFERENCE TO RELATED APPLICATIONS

This application claims the priority benefit of Japanese Patent Application No. 2018-086862, filed on Apr. 27, 2018. The entirety of the above-mentioned patent application is hereby incorporated by reference herein and made a part of this specification.

TECHNICAL FIELD

The present disclosure relates to a head holding mechanism that holds an inkjet head mounted on a carriage. The present disclosure also relates to an inkjet printer equipped with such a head holding mechanism.

DESCRIPTION OF THE BACKGROUND ART

An inkjet printer that performs printing by ejecting ink onto a medium is conventionally known (see e.g., Japanese Unexamined Patent Publication No. 2016-215421). The inkjet printer described in Japanese Unexamined Patent Publication No. 2016-215421 includes a plurality of inkjet heads (liquid ejection heads) for ejecting ink supplied from an ink container and a carriage on which the plurality of inkjet heads are mounted. The plurality of inkjet heads are fixed to a base plate assembled to the carriage through an adjustment mechanism.

In the inkjet printer described in Japanese Unexamined Patent Publication No. 2016-215421, the adjustment mechanism includes a first plate fixed to the base plate and a second plate to which the inkjet head is fixed and which is fixed to the first plate. The first plate is fixed to the base frame by screws and the second plate is fixed to the first plate by screws. In addition, the inkjet head is fixed to the second plate by screws.

In the inkjet printer described in Japanese Unexamined Patent Publication No. 2016-215421, the first plate can be turned with respect to the base plate with a vertical direction as an axial direction of turn by loosening the screw for fixing the first plate to the base frame. Furthermore, the second plate can be linearly moved in the sub-scanning direction with respect to the first plate by loosening the screw for fixing the second plate to the first plate. Therefore, in the inkjet printer described in Japanese Unexamined Patent Publication No. 2016-215421, it is possible to adjust the position of the inkjet head with respect to the carriage.

In the inkjet printer described in Japanese Unexamined Patent Publication No. 2016-215421, when replacing the inkjet head mounted on the carriage, for example, the screw for fixing the second plate to the first plate is detached, the second plate in a state where the inkjet head before the replacement is fixed is detached from the first plate, and then the second plate in a state where the inkjet head after the replacement is fixed is fixed to the first plate by screws.

SUMMARY

In the inkjet printer described in Japanese Unexamined Patent Publication No. 2016-215421, the screw for fixing the second plate to the first plate must be detached when replacing the inkjet head mounted on the carriage. Thus, in such an inkjet printer, a tool such as a driver is required when replacing the inkjet head mounted on the carriage, and the replacement task of the inkjet head becomes complex.

The present disclosure thus provides a head holding mechanism that holds an inkjet head mounted on a carriage, where the head holding mechanism can simplify a replacement operation of the inkjet head. The present disclosure also provides an inkjet printer equipped with such a head holding mechanism.

In order to solve the above problem, a head holding mechanism of the present disclosure relates to a head holding mechanism that holds an inkjet head mounted on a carriage. The head holding mechanism includes: a head holding member that holds the inkjet head; a carriage side member attached to the carriage and to which the head holding member is fixed; and a fixing member for fixing the head holding member to the carriage side member, where the fixing member is movably held by one of the head holding member and the carriage side member, and is movable between an engagement position where the fixing member engages with the other one of the head holding member and the carriage side member to fix the head holding member to the carriage side member, and a disengagement position where the engagement state of the other one of the head holding member and the carriage side member and the fixing member is released and the head holding member is detachable from the carriage side member.

In the head holding mechanism of the present disclosure, the fixing member for fixing the head holding member to the carriage side member is held by one of the head holding member and the carriage side member so as to be movable between the engagement position where the fixing member engages with the other one of the head holding member and the carriage side member to fix the head holding member to the carriage side member, and a disengagement position where the engagement state of the other one of the head holding member and the carriage side member and the fixing member is released and the head holding member is detachable from the carriage side member.

Therefore, in the present disclosure, the fixing member at the engagement position is moved to the disengagement position, the head holding member in a state where an inkjet head before replacement is attached is detached from the carriage side member, and thereafter the head holding member in a state where an inkjet head after replacement is attached is set at a predetermined position of the carriage side member, and the fixing member at the disengagement position is moved to the engagement position to replace the inkjet head. That is, in the present disclosure, the inkjet head can be replaced without using a tool such as a driver or without detaching the fixing member. Therefore, according to the present disclosure, the replacement task of the inkjet head can be simplified. Furthermore, in the present disclosure, since the inkjet head can be replaced without detaching the fixing member, the fixing member can be prevented from getting lost at the time of replacing the inkjet head.

In the present disclosure, the fixing member is preferably turnable between the engagement position and the disengagement position with the vertical direction as the axial direction of turn. According to such a configuration, the movable region of the fixing member can be narrowed as compared with the case where the fixing member linearly moves between the engagement position and the disengagement position. Therefore, the head holding mechanism can be miniaturized.

In the present disclosure, the fixing member is preferably movably held by the carriage side member and engages with the head holding member at the engagement position.

According to such a configuration, the fixing member does not need to be attached to each of the head holding members detached from the carriage side member together with the inkjet head. Therefore, the configuration of the member to be replaced together with the inkjet head can be simplified.

In the present disclosure, the carriage side member includes a first carriage side member fixed to the carriage, and a second carriage side member movably attached to the first carriage side member and to which the head holding member is fixed; the second carriage side member is turnable with respect to the first carriage side member with the vertical direction as an axial direction of turn or is linearly movable in a main scanning direction, which is a moving direction of the carriage, and a sub scanning direction, which is orthogonal to the vertical direction, with respect to the first carriage side member; and the fixing member is preferably movably held by one of the head holding member and the second carriage side member.

According to such a configuration, even if the second carriage side member moves with respect to the first carriage side member, the relative position between the second carriage side member and the head holding member does not change. Therefore, even if the second carriage side member is turnable or linearly movable with respect to the first carriage side member, the head holding member can be securely fixed to the second carriage side member by the fixing member movably held by one of the head holding member and the second carriage side member.

In the present disclosure, for example, the head holding member is fixed to the second carriage side member in a state of being positioned with respect to the second carriage side member in the horizontal direction.

In the present disclosure, for example, the inkjet head is turnable with respect to the head holding member with the vertical direction as the axial direction of turn, or is linearly movable in a main scanning direction, which is a moving direction of the carriage, and a sub scanning direction, which is orthogonal to the vertical direction, with respect to the head holding member. In this case, even if the inkjet head moves with respect to the head holding member, the relative position between the head holding member and the carriage side member does not change. Therefore, even if the inkjet head is turnable or linearly movable with respect to the head holding member, the head holding member can be securely fixed to the carriage side member by the fixing member movably held by one of the head holding member and the carriage side member.

In the present disclosure, the head holding mechanism preferably includes a fixing member holding mechanism that holds the fixing member at the engagement position. According to such a configuration, the fixing member can be reliably held at the engagement position. Therefore, the head holding member can be reliably fixed to the carriage side member by the fixing member.

The head holding mechanism of the present disclosure includes an inkjet head and a carriage, and can be used for an inkjet printer that performs printing on a medium. In this inkjet printer, the replacement task of the inkjet head can be simplified.

As described above, in the head holding mechanism and the inkjet printer of the present disclosure, the replacement task of the inkjet head can be simplified.

DESCRIPTION OF EMBODIMENTS

Hereinafter, embodiments of the present disclosure will be described with reference to the accompanying drawings.

First Embodiment (Schematic Configuration of Inkjet Printer)

Figure 1:
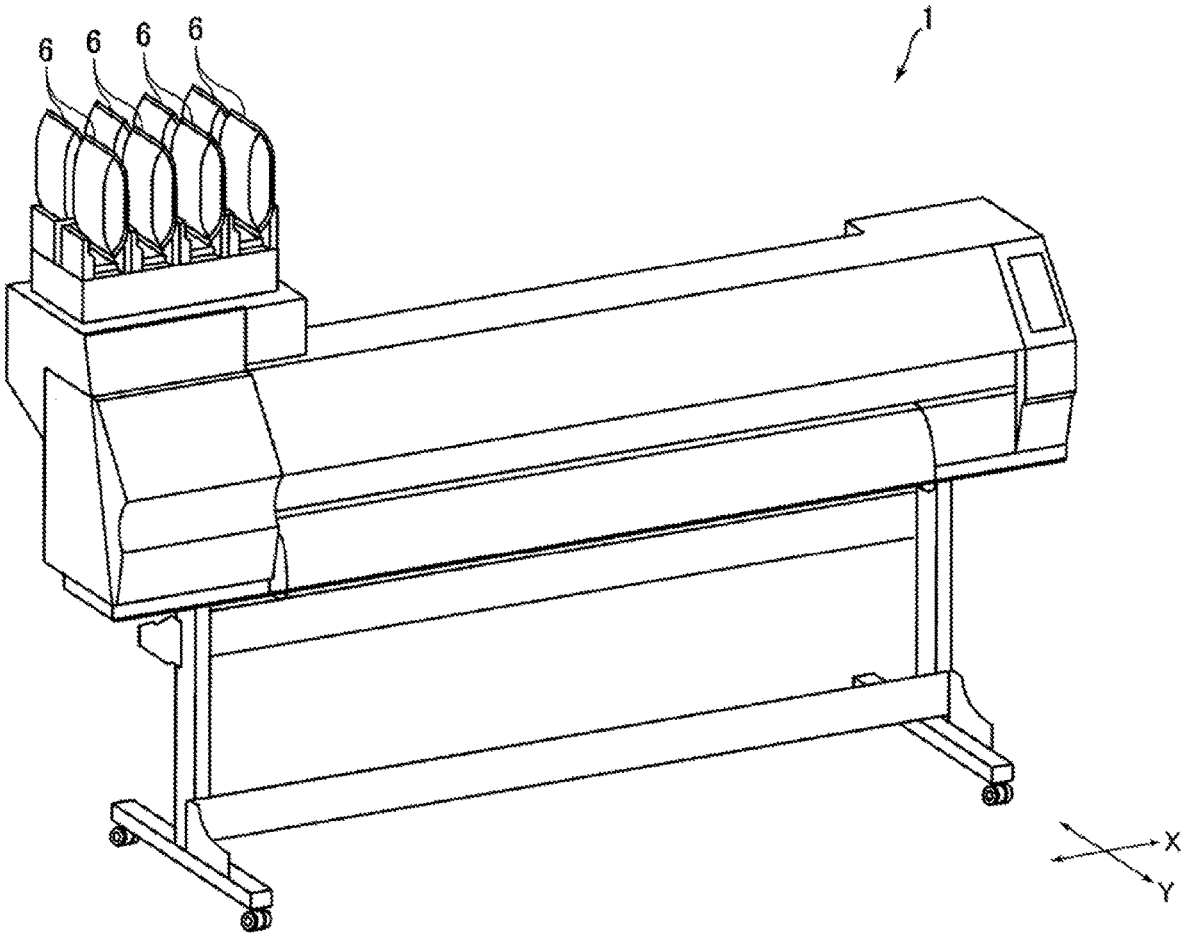
FIG. 1 is a perspective view of an inkjet printer according to an embodiment of the present disclosure.
Figure 2:
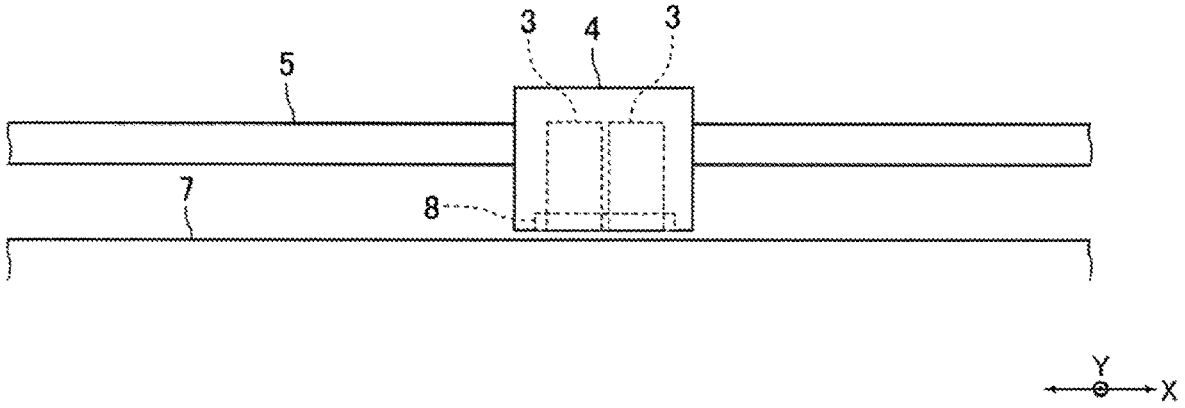
FIG. 2 is a schematic view showing a carriage and the like of the inkjet printer shown in FIG. 1.

FIG. 1 is a perspective view of an inkjet printer 1 according to an embodiment of the present disclosure. FIG. 2 is a schematic view showing a carriage 4 and the like of the inkjet printer 1 shown in FIG. 1.

An inkjet printer 1 (hereinafter referred to as "printer 1") of the present embodiment is a business inkjet printer, and performs printing on a medium such as paper or cloth. The printer 1 includes an inkjet head 3 (hereinafter referred to as a "head 3") that ejects ink droplets toward a medium, a carriage 4 on which the head 3 is mounted, a carriage driving mechanism (not shown) that moves the carriage 4 in a main scanning direction (X direction in FIG. 1, etc.), a guide rail 5 that guides the carriage 4 in the main scanning direction, and a plurality of ink tanks 6 in which ink to be supplied to the head 3 is stored.

The head 3 ejects ink droplets downward. A platen 7 is disposed on the lower side of the head 3. A medium to be printed is placed on the platen 7. Furthermore, the printer 1 includes a head holding mechanism 8 that holds the head 3 mounted on the carriage 4. The head holding mechanism 8 is mounted on the carriage 4. In the present embodiment, two heads 3 are held by the head holding mechanism 8. Hereinafter, the configuration of the head holding mechanism 8 will be described.

(Configuration of Head Holding Mechanism)

Figure 3:
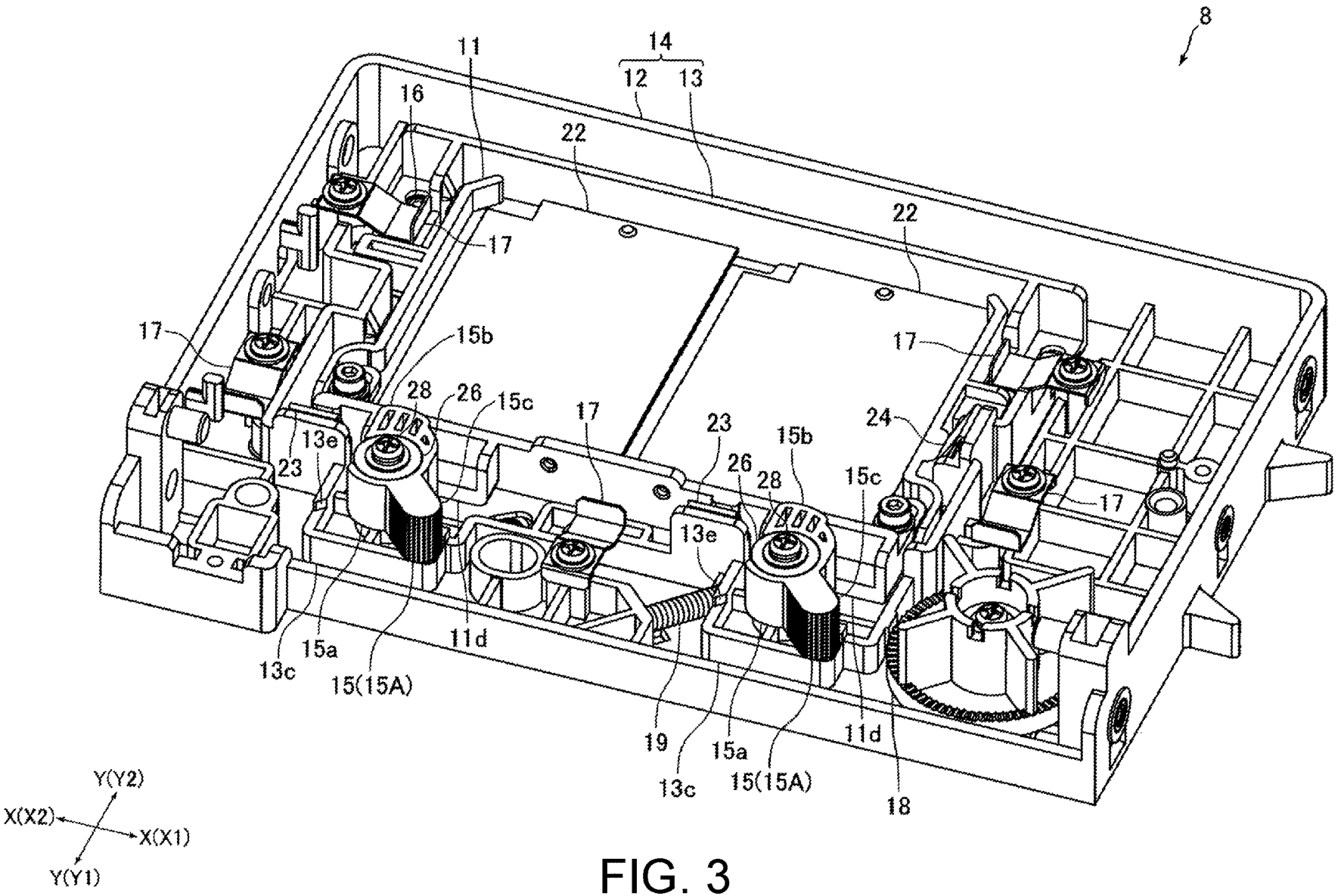
FIG. 3 is a perspective view of a head holding mechanism according to a first embodiment of the present disclosure.
Figure 4:
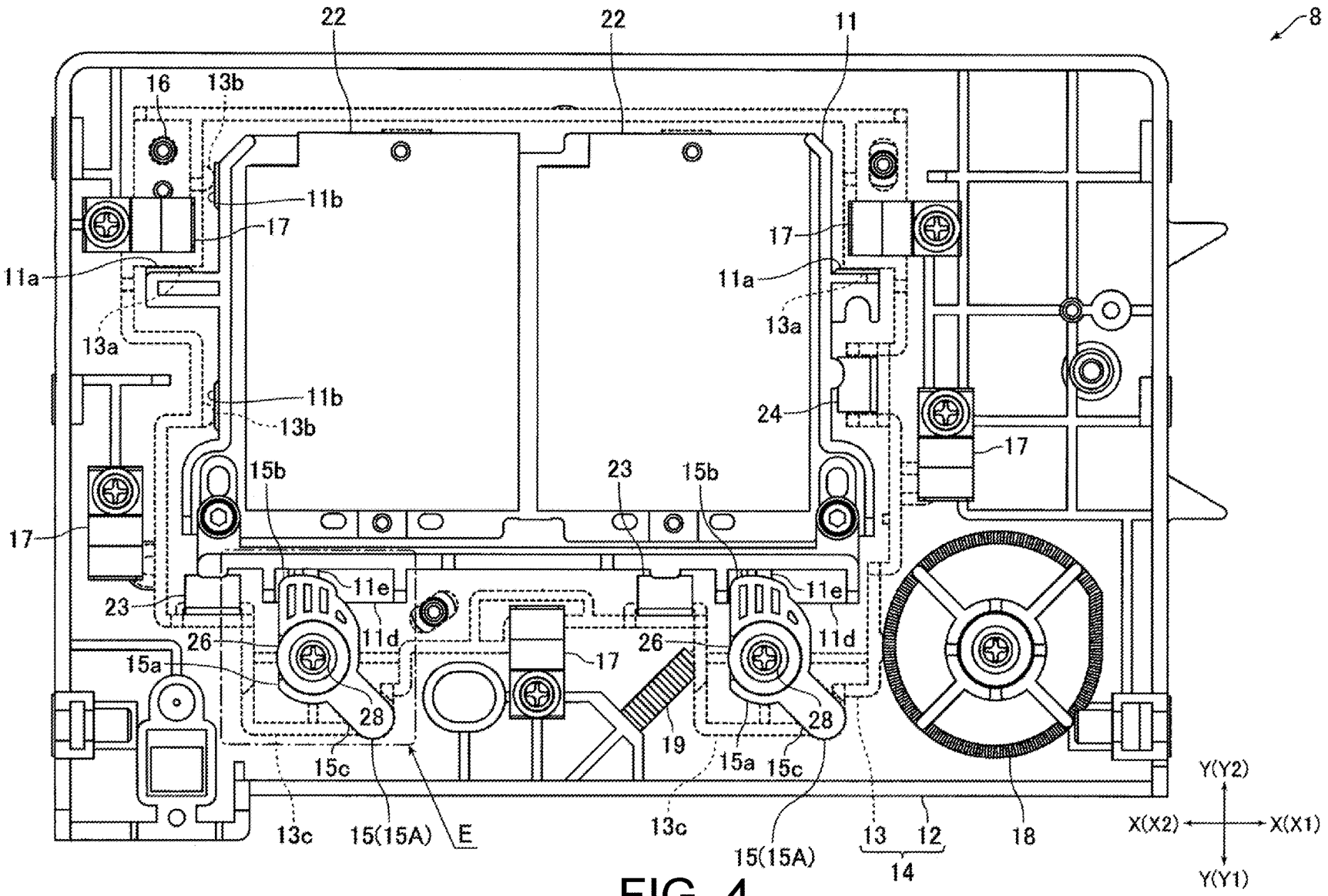
FIG. 4 is a plan view of the head holding mechanism shown in FIG. 3.
Figure 5A:
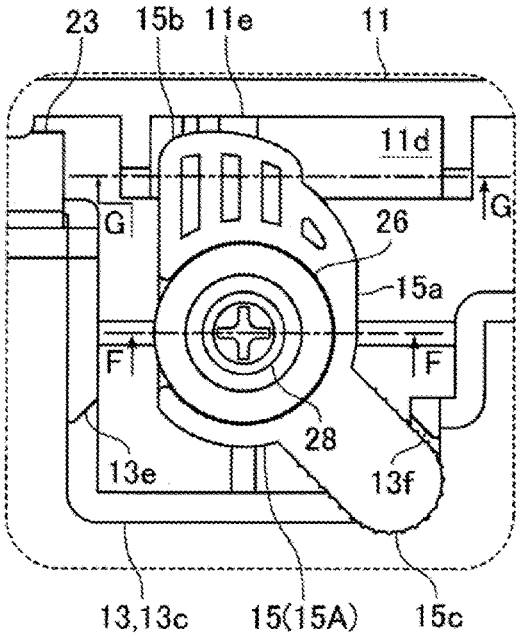
FIG. 5A and FIG. 5B are enlarged views for explaining a configuration of portion E of FIG. 4.
Figure 5B:
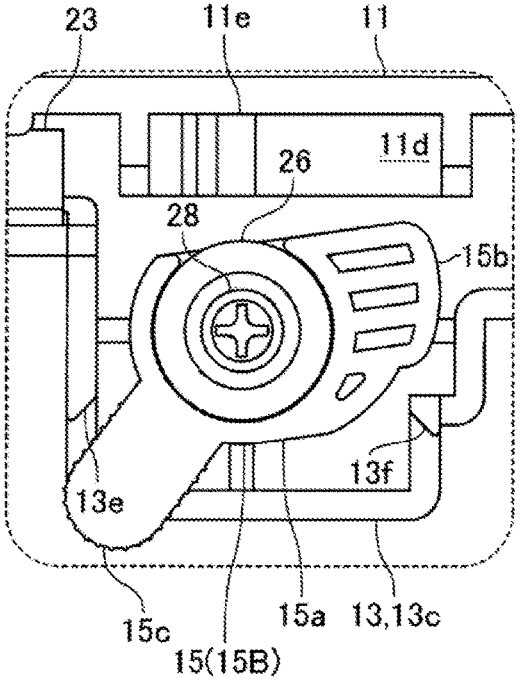
Figure 5B:
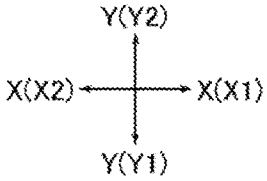
Figure 6:
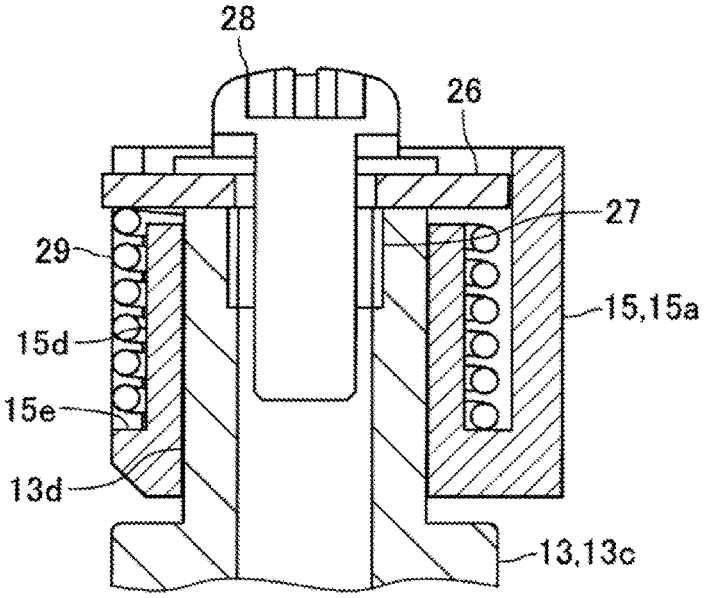
FIG. 6 is a cross-sectional view taken along line F-F in FIG. 5A.
Figure 6:
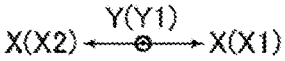
Figure 7:
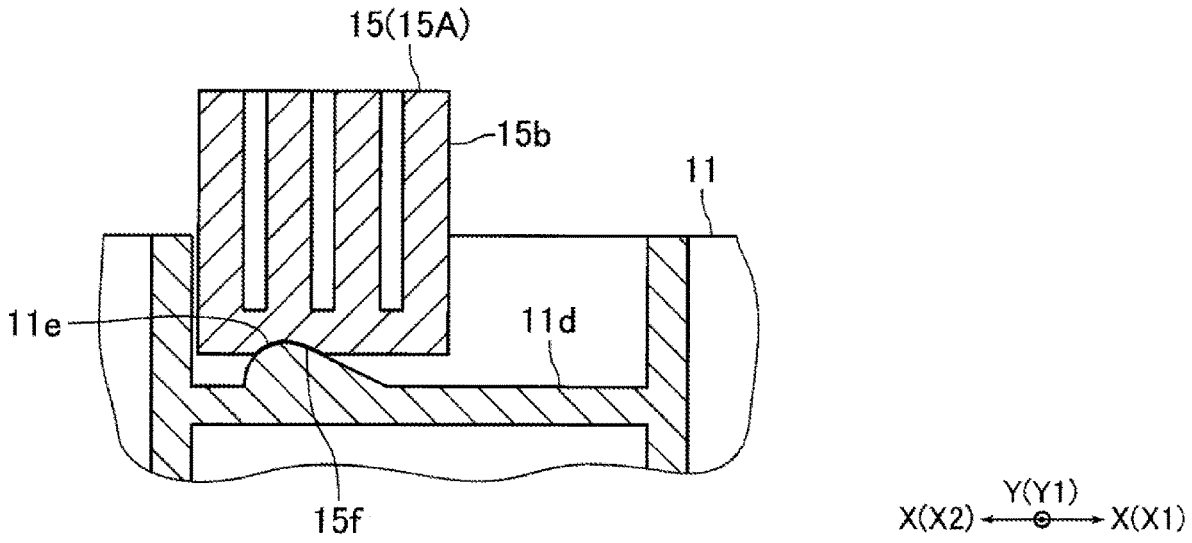
FIG. 7 is a cross-sectional view taken along line G-G in FIG. 5A.
Figure 8:
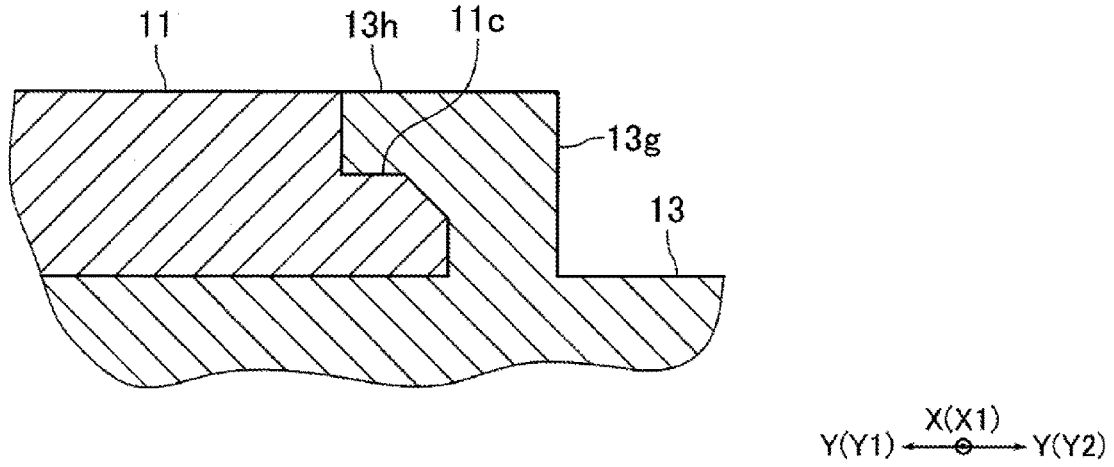
FIG. 8 is a cross-sectional view for explaining a configuration of an engagement portion between a back end of the head holding member and a back end of an intermediate member shown in FIG. 3.

FIG. 3 is a perspective view of the head holding mechanism 8 according to the first embodiment of the present disclosure. FIG. 4 is a plan view of the head holding mechanism 8 shown in FIG. 3. FIG. 5A and FIG. 5B are enlarged views for explaining the configuration of portion E of FIG. 4. FIG. 6 is a cross-sectional view taken along the line F-F in FIG. 5A. FIG. 7 is a cross-sectional view taken along the line G-G in FIG. 5A. FIG. 8 is a cross-sectional view for explaining a configuration of an engagement portion between a back end of a head holding member 11 and a back end of an intermediate member 13 shown in FIG. 3.

In the following description, a main scanning direction (X direction) is assumed as a "left and right direction" and a sub-scanning direction (Y direction in FIG. 1, etc.) orthogonal to the vertical direction and the left and right direction (main scanning direction) is assumed as a "front and back direction". Furthermore, the X1 direction side of FIG. 3 or the like which is one side in the left and right direction is defined as the "right" side, the X2 direction side of FIG. 3 or the like on the opposite side is defined as the "left" side, the Y1 direction side of FIG. 3 or the like which is one side in the front and back direction is defined as the "front" side, and the Y2 direction side of FIG. 3 or the like on the opposite side is defined as the "back" side.

The head holding mechanism 8 includes a head holding member 11 that holds the head 3, a base member 12 that is fixed to the carriage 4, and an intermediate member 13 that is movably attached to the base member 12 and to which the head holding member 11 is fixed. In the present embodiment, the base member 12 and the intermediate member 13 constitute a carriage side member 14 attached to the carriage 4 and to which the head holding member 11 is fixed. The base member 12 of the present embodiment is a first carriage side member and the intermediate member 13 is a second carriage side member. In FIG. 4, the intermediate member 13 is indicated by a broken line for the sake of convenience of explanation.

Furthermore, the head holding mechanism 8 includes a fixing lever 15 for fixing the head holding member 11 to the intermediate member 13. That is, the head holding mechanism 8 includes the fixing lever 15 for fixing the head holding member 11 to the carriage side member 14. The head holding mechanism 8 of the present embodiment includes two fixing levers 15. The two fixing levers 15 are disposed with a space in the left and right direction. The fixing lever 15 is turnable with the vertical direction as the axial direction of turn. In the present embodiment, the user manually turns the fixing lever 15. The fixing lever 15 of the present embodiment is a fixing member.

The base member 12 is formed to a flat substantially rectangular parallelepiped box shape in which an upper surface is opened and the thickness in the vertical direction is thin. The intermediate member 13 is also formed to a flat substantially rectangular parallelepiped box shape in which an upper surface is opened and the thickness in the vertical direction is thin. The outer shape of the intermediate member 13 is smaller than the outer shape of the base member 12. The intermediate member 13 is mounted on the upper surface of the bottom portion of the base member 12. In addition, the intermediate member 13 is attached to the base member 12 so as to be turnable with respect to the base member 12 with the vertical direction as the axial direction of turn.

A turning center shaft 16 serving as the turning center of the intermediate member 13 is fixed to the left back end of the base member 12. The turning center shaft 16 is disposed so that the axial direction of the turning center shaft 16 and the vertical direction coincide. The turning center shaft 16 is inserted to the bottom portion of the intermediate member 13. The intermediate member 13 is pressed against the upper surface of the bottom portion of the base member 12 by a plurality of plate springs 17. In the present embodiment, the intermediate member 13 is pressed against the upper surface of the bottom portion of the base member 12 by two plate springs 17 disposed on the right end side of the intermediate member 13, two plate springs 17 disposed on the left end side of the intermediate member 13, and one plate spring 17 disposed on the front end side of the intermediate member 13. One end of the plate spring 17 is fixed to the base member 12, and the other end of the plate spring 17 is brought into contact with the upper surface of the bottom portion of the intermediate member 13.

The outer peripheral surface of an eccentric cam 18 for adjusting the turning angle of the intermediate member 13 with respect to the base member 12 is brought into contact with the front end of the right end face of the intermediate member 13. The eccentric cam 18 is attached to the base member 12 so as to be turnable with the vertical direction as the axial direction of turn. The intermediate member 13 is biased in a counterclockwise direction in FIG. 4 (hereinafter referred to as "counterclockwise direction") with the turning center shaft 16 as the center by a compression coil spring 19 disposed on the front end side of the intermediate member 13. Therefore, the front end of the right end face of the intermediate member 13 is brought into contact with the outer peripheral surface of the eccentric cam 18 with a predetermined contact pressure. The turning angle of the intermediate member 13 with respect to the base member 12 is adjusted by turning the eccentric cam 18.

The intermediate member 13 is formed with a positioning portion 13*a* for positioning the head holding member 11 in the front and back direction and a positioning portion 13*b* for positioning the head holding member 11 in the left and right direction. The positioning portion 13*a* is a plane orthogonal to the front and back direction. Furthermore, the positioning portion 13*a* is a plane facing the front side. The positioning portion 13*a* is formed on the back end side of the intermediate member 13 and is formed at two locations on both left and right end sides. The positioning portion 13*b* is formed to a hemispherical shape. The positioning portion 13*b* is formed on the left end side of the intermediate member 13 and is formed at two locations with a space in the front and back direction. The vertex of the positioning portion 13*b* formed to a hemispherical shape is located at the right end of the positioning portion 13*b*.

The intermediate member 13 is formed with two lever attachment portions 13*c* to which the fixing lever 15 is turnably attached. That is, the fixing lever 15 is movably held by the intermediate member 13. Specifically, the fixing lever 15 is turnably held by the intermediate member 13. Furthermore, the fixing lever 15 is held to be movable (turnable) to the carriage side member 14. The lever attachment portion 13*c* is formed at the front end of the intermediate member 13. Furthermore, the lever attachment portion 13*c* is formed at two locations on both left and right end sides of the intermediate member 13. The lever attachment portion 13*c* projects out toward the front side.

A cylindrical lever supporting protrusion 13*d* for turnably supporting the fixing lever 15 is formed in the lever attachment portion 13*c* (see FIG. 6). The lever supporting protrusion 13*d* is formed at the center part of the lever attachment portion 13*c*. The lever supporting protrusion 13*d* is raised toward the upper side. Regulation surfaces 13*e* and 13*f* for regulating the turning range of the fixing lever 15 are formed in the lever attachment portion 13*c* (see FIG. 5A and FIG. 5B). Specifically, the regulation surface 13*e* for regulating the turning range the fixing lever 15 in the clockwise direction in FIG. 4 (hereinafter, this direction is referred to as "clockwise direction") and the regulation surface 13*f* for regulating the turning range of the fixing lever 15 in the counterclockwise direction are formed in the lever attachment portion 13*c*.

A protruding portion 13*g* for preventing the head holding member 11 fixed to the intermediate member 13 from lifting is formed at the back end of the intermediate member 13 (see FIG. 8). The protruding portion 13*g* is formed to a hook shape that engages with the back end of the head holding member 11 from the back side. The protruding portion 13*g* projects out toward the upper side. The protruding portion 13*g* is formed with a pressing portion 13*h* that comes into contact with an engagement portion 11*c*, to be described later, formed on the head holding member 11 from the upper side and presses the engagement portion 11*c* from the upper side. The pressing portion 13*h* projects out toward the front side.

The head holding member 11 is formed to a substantially rectangular thick plate shape as a whole. The outer shape of the head holding member 11 is smaller than the outer shape of the intermediate member 13. The head holding member 11 is placed on the upper surface of the bottom portion of the intermediate member 13. A fixing plate 22 to which the bottom surface of the head 3 is fixed is fixed to the upper surface of the head holding member 11. The fixing plate 22 is fixed at two locations on the upper surface of the head holding member 11 so as to be adjacent to each other in the left and right direction. A through hole (not shown) is formed in the fixing plate 22 so that the nozzle surface of the head 3 is exposed. In the present embodiment, the two heads 3 are fixed to the head holding member 11 by way of the fixing plate 22 in a state where the positions are adjusted in the front and back direction and the left and right direction.

As shown in FIG. 4, the head holding member 11 is formed with a contacting surface 11*a* that contacts the positioning portion 13*a* to position the head holding member 11 in the front and back direction, and a contacting surface 11*b* that contacts the positioning portion 13*b* to position the head holding member 11 in the left and right direction. The contacting surface 11*a* is a plane orthogonal to the front and back direction and is formed on both left and right end sides of the head holding member 11. Furthermore, the contacting surface 11*a* is a plane facing the back side. The contacting surface 11*b* is a plane orthogonal to the left and right direction, and is disposed in a state of being spaced apart in the front and back direction. Furthermore, the contacting surface 11*b* is a plane facing the left side.

A plate spring 23 that biases the head holding member 11 toward the back side with respect to the intermediate member 13, and a plate spring 24 that biases the head holding member 11 toward the left side with respect to the intermediate member 13 are disposed between the head holding member 11 and the intermediate member 13. The plate spring 23 is in contact with the front end face of the head holding member 11. Furthermore, the two plate springs 23 are disposed in a state of being spaced apart in the left and right direction. The plate spring 24 is in contact with the right end face of the head holding member 11. Furthermore, one plate spring 23 is disposed at an intermediate position of the head holding member 11 in the front and back direction. The head holding member 11 may be biased by a spring member other than the plate springs 23 and 24.

The positioning portion 13*a* and the contacting surface 11*a* are in contact with each other with a predetermined contact pressure by the biasing force of the plate spring 23, and the head holding member 11 is positioned with respect to the intermediate member 13 in the front and back direction. The apex of the positioning portion 13*b* and the contacting surface 11*b* are in contact with each other with a predetermined contact pressure by the biasing force of the plate spring 24, and the head holding member 11 is positioned with respect to the intermediate member 13 in the left and right direction. That is, the head holding member 11 is fixed to the intermediate member 13 in a state of being positioned with respect to the intermediate member 13 in the horizontal direction.

As shown in FIG. 8, the engagement portion 11*c* that engages with the protruding portion 13*g* of the intermediate member 13 from the front side is formed at the back end of the head holding member 11. The engagement portion 11*c* is formed on the lower end side of the head holding member 11. Furthermore, the engagement portion 11*c* projects out toward the back side. The engagement portion 11*c* is disposed on the lower side the pressing portion 13*h* of the protruding portion 13*g*, and the upper surface of the engagement portion 11*c* is brought into contact with the lower surface of the pressing portion 13*h*. The protruding portion 13*g* and the engagement portion 11*c* prevent the head holding member 11 from lifting up with respect to the intermediate member 13.

The head holding member 11 is formed with two engagement portions 11*d* with which a part of the fixing lever 15 engages. The engagement portion 11*d* is formed at the front end of the head holding member 11. In addition, the engagement portion 11*d* is formed at two locations on both left and right end sides of the head holding member 11. The upper surface of the engagement portion 11*d* is a plane orthogonal to the vertical direction. A convex portion 11*e* for holding the fixing lever 15 at an engagement position 15A, to be described later, is formed on the upper surface of the engagement portion 11*d*. The convex portion 11*e* projects out toward the upper side. The upper surface of the convex portion 11*e* as viewed from the front and back direction is constituted by an inclined surface inclined so as to head toward the upper side toward the left side and a convex curved surface of a substantially semicircular arc shape smoothly connected to the upper end of the inclined surface (see FIG. 7).

The fixing lever 15 includes a center portion 15*a* through which the lever supporting protrusion 13*d* is inserted, an engagement portion 15*b* that engages with the engagement portion 11*d* of the head holding member 11, and a knob portion 15*b* that is held when the user manually turns the fixing lever 15. The fixing lever 15 turns about the lever supporting protrusion 13*d*. The engagement portion 15*b* projects out in the horizontal direction from the center portion 15*a*. The knob portion 15*c* also projects out in the horizontal direction from the center portion 15*a*. As viewed from the vertical direction, the angle formed by the engagement portion 15*b* and the knob portion 15*c* is, for example, about 120°.

As shown in FIG. 6, a cylindrical cylinder portion 15*d* through which the lever supporting protrusion 13*d* is inserted on the inner peripheral side is formed in the center portion 15*a*. A spring pressing member 26 formed to a flat plate shape and a circular ring shape is fixed to the upper end of the lever supporting protrusion 13*d*. The cylinder portion 15*d* is disposed on the lower side of the spring pressing member 26. The outer diameter of the spring pressing member 26 is larger than the outer diameter of the cylinder portion 15*d*. A nut 27 is fixed to the inner peripheral side of the lever supporting protrusion 13*d*. The spring pressing member 26 is fixed to the upper end of the lever supporting protrusion 13*d* by a screw 28 screwed into the nut 27 from the upper side of the spring pressing member 26.

The cylinder portion 15*d* is inserted into the inner peripheral side of the compression coil spring 29. The upper end of the compression coil spring 29 is brought into contact with the lower surface of the spring pressing member 26. The lower end of the compression coil spring 29 is brought into contact with a contact surface 15*e* that spreads outward in the radial direction of the cylinder portion 15*d* from the lower end of the cylinder portion 15*d*. The fixing lever 15 is biased toward the lower side by the biasing force of the compression coil spring 29. As shown in FIG. 7, a concave portion 15*f* into which the convex portion 11*e* of the head holding member 11 is fitted is formed on the lower surface of the engagement portion 15*b*. The concave portion 15*f* is recessed toward the upper side from the lower surface of the engagement portion 15*b*.

The fixing lever 15 is turnable between an engagement position 15A where the fixing lever 15 engages with the head holding member 11 (specifically, engagement portion 15*b* engages with engagement portion 11*d*) to fix the head holding member 11 to the intermediate member 13 (position shown in FIG. 3, FIG. 4, and FIG. 5A), and a disengagement position 15B where the engagement state of the head holding member 11 and the fixing lever 15 (specifically, engagement state of engagement portion 11*d* and engagement portion 15*b*) is released and the head holding member 11 can be detached from the intermediate member 13 (position shown in FIG. 5B).

That is, the fixing lever 15 is movable between the engagement position 15A and the disengagement position 15B. Furthermore, the fixing lever 15 is engaged with the head holding member 11 at the engagement position 15A. In the present embodiment, the fixing lever 15 moves to the disengagement position 15B when the fixing lever 15 at the engagement position 15A is turned in the clockwise direction, and the fixing lever 15 moves to the engagement position 15A when the fixing lever 15 at the disengagement position 15B is turned in the counterclockwise direction.

When the fixing lever 15 is at the engagement position 15A, the engagement portion 15*b* of the fixing lever 15 is disposed on the upper side of the engagement portion 11*d* of the head holding member 11. Furthermore, when the fixing lever 15 is at the engagement position 15A, the convex portion 11*e* of the head holding member 11 is fitted to the concave portion 15*f* of the fixing lever 15. Moreover, when the fixing lever 15 is at the disengagement position 15B, the engagement portion 15*b* is disposed at a position deviated from the upper side of the engagement portion 11*d*. In the present embodiment, the fixing member holding mechanism that holds the fixing lever 15 at the engagement position 15A is configured by the convex portion 11*e*, the concave portion 15*f*, and the compression coil spring 29.

When replacing the head 3 mounted on the carriage 4 in the printer 1, first, the fixing lever 15 at the engagement position 15A is turned to the disengagement position 15B, and then the head holding member 11, to which the head 3 before replacement is fixed, is moved toward the front side and detached from the intermediate member 13. Thereafter, the head holding member 11, to which the head 3 after replacement is fixed, is moved toward the back side and attached to the intermediate member 13, and the fixing lever 15 at the disengagement position 15B is turned to the engagement position 15A.

(Main Effect of Present Embodiment)

As described above, in the present embodiment, the fixing lever 15 for fixing the head holding member 11 to the intermediate member 13 is turnably held by the intermediate member 13, and is turnable between the engagement position 15A where the fixing lever 15 engages with the head holding member 11 to fix the head holding member 11 to the intermediate member 13, and the disengagement position 15B where the engagement state of the head holding member 11 and the fixing lever 15 is released and the head holding member 11 can be detached from the intermediate member 13. Therefore, in the present embodiment, the head 3 mounted on the carriage 4 can be replaced, as described above, by turning the fixing lever 15.

That is, in the present embodiment, the head 3 can be replaced without using a tool such as a driver or without detaching the fixing lever 15 from the intermediate member 13. Therefore, in the present embodiment, the replacement task of the head 3 can be simplified. Furthermore, in the present embodiment, since the head 3 can be replaced without detaching the fixing lever 15, the fixing lever 15 can be prevented from getting lost at the time of replacing the head 3.

In the present embodiment, the fixing lever 15 is turnably held by the intermediate member 13. Thus, in the present embodiment, the relative position between the fixed lever 15 and the head holding member 11 does not change even if the intermediate member 13 is turned with respect to the base member 12. Therefore, in the present embodiment, the head holding member 11 can be reliably fixed to the intermediate member 13 with the fixing lever 15 even if the intermediate member 13 is turnable with respect to the base member 12.

In the present embodiment, the fixing member holding mechanism that holds the fixing lever 15 at the engagement position 15A is configured by the convex portion 11*e* of the head holding member 11, the concave portion 15*f* of the fixing lever 15, and the compression coil spring 29. Thus, in the present embodiment, the fixing lever 15 can be reliably held at the engagement position 15A. Therefore, in the present embodiment, the head holding member 11 can be reliably fixed to the intermediate member 13 by the fixing lever 15.

Second Embodiment

Figure 9:
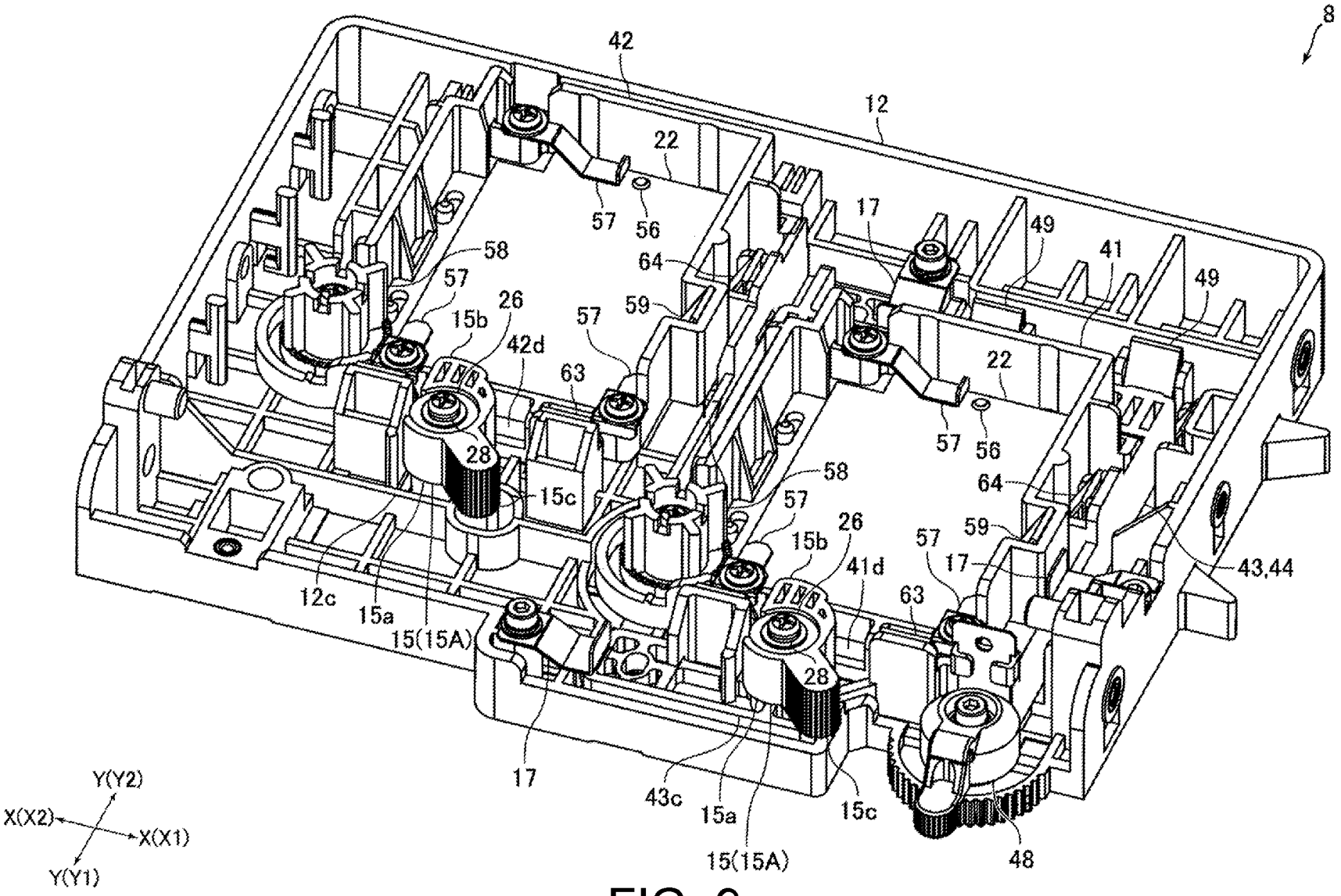
FIG. 9 is a perspective view of a head holding mechanism according to a second embodiment of the present disclosure.
Figure 10:
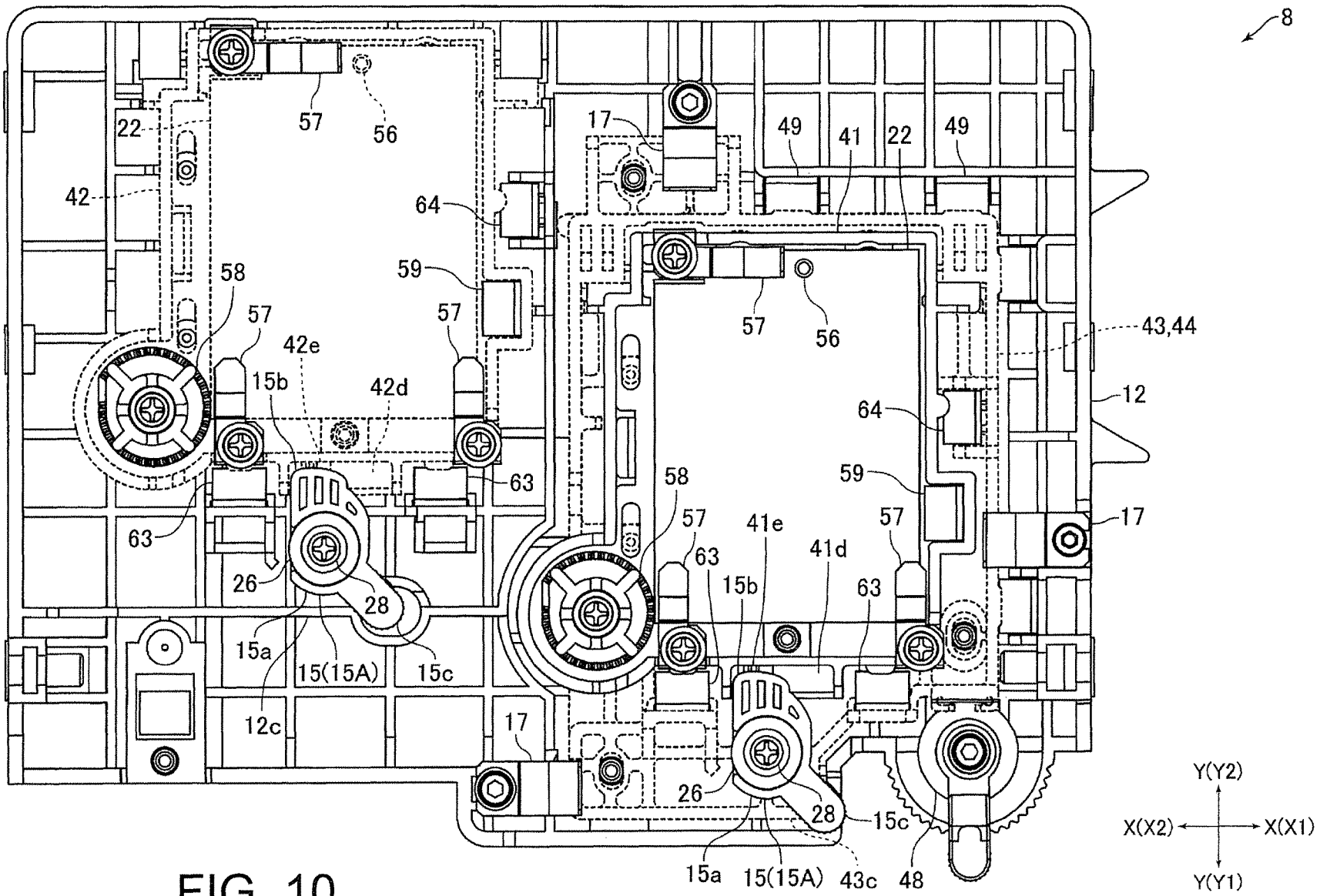
FIG. 10 is a plan view of the head holding mechanism shown in FIG. 9.

FIG. 9 is a perspective view of a head holding mechanism 8 according to a second embodiment of the present disclosure. FIG. 10 is a plan view of the head holding mechanism 8 shown in FIG. 9.

The head holding mechanism 8 according to the first embodiment includes one intermediate member 13 movably attached to the base member 12 and one head holding member 11 fixed to the intermediate member 13, where the one head holding member 11 holds two heads 3. On the other hand, the head holding mechanism 8 according to the second embodiment includes one intermediate member 43 movably attached to the base member 12, one head holding member 41 that holds one head 3 and is fixed to the intermediate member 43, and one head holding member 42 that holds one head 3 and is fixed to the base member 12. Furthermore, the fixing lever 15 for fixing the head holding member 41 to the intermediate member 43 is turnably held by the intermediate member 43, and the fixing lever 15 for fixing the head holding member 42 to the base member 12 is turnably held by the base member 12.

In the present embodiment, the base member 12 and the intermediate member 43 constitute a carriage side member 44 that is attached to the carriage 4 and to which the head holding member 41 is fixed. The base member 12 of the present embodiment is a first carriage side member and the intermediate member 43 is a second carriage side member. In addition, in the present embodiment, the base member 12 constitutes a carriage side member that is attached to the carriage 4 and to which the head holding member 42 is fixed. Hereinafter, the configuration of the head holding mechanism 8 of the present embodiment will be described. In the following description, the same reference numerals are denoted to the same configurations as those in the first embodiment, and the description thereof will be omitted or simplified. In FIG. 10, the head holding member 42 and the intermediate member 43 are indicated by broken lines for the sake of convenience of explanation.

Similarly to the intermediate member 13, the intermediate member 43 is formed to a flat substantially rectangular parallelepiped box shape in which an upper surface is opened and the thickness in the vertical direction is thin. The outer shape of the intermediate member 43 is smaller than the outer shape of the base member 12. The intermediate member 43 is mounted on the upper surface of the bottom portion of the base member 12. In addition, the intermediate member 43 is attached to the base member 12 so as to be linearly movable in the front and back direction with respect to the base member 12. The intermediate member 43 is pressed against the upper surface of the bottom portion of the base member 12 by a plurality of plate springs 17. In the present embodiment, the intermediate member 43 is pressed against the upper surface of the bottom portion of the base member 12 by one plate spring 17 disposed on the right end side of the intermediate member 43, one plate spring 17 disposed on the left front end side of the intermediate member 43, and one plate spring 17 disposed on the left back end side of the intermediate member 43.

The outer peripheral surface of an eccentric cam 48 for adjusting the position in the front and back direction of the intermediate member 43 with respect to the base member 12 is brought into contact with the right end of the front end face of the intermediate member 43. The eccentric cam 48 is attached to the base member 12 so as to be turnable with the vertical direction as the axial direction of turn. The intermediate member 43 is biased to the front side by two plate springs 49 disposed on the back end side of the intermediate member 43. Therefore, the right end of the front end face of the intermediate member 43 is in contact with the outer peripheral surface of the eccentric cam 48 with a predetermined contact pressure. The intermediate member 43 is positioned in the left and right direction with respect to the base member 12. The position in the front and back direction of the intermediate member 43 with respect to the base member 12 is adjusted by turning the eccentric cam 48.

A lever attachment portions 43*c* to which one fixing lever 15 is turnably attached is formed at the front end of the intermediate member 43. Similarly to the lever attachment portion 13*c* of the first embodiment, the lever attachment portion 43*c* includes a lever supporting protrusion formed to a cylindrical shape, and the fixing lever 15 is turnably attached to the lever attachment portion 43*c*, similarly to the first embodiment. Similarly to the intermediate member 13, the intermediate member 43 is formed with a positioning portion for positioning the head holding member 41 in the front and back direction and a positioning portion for positioning the head holding member 41 in the left and right direction. Furthermore, a protruding portion for preventing the head holding member 41 from lifting is formed at the back end of the intermediate member 43. The protruding portion is formed similarly to the protruding portion 13*g*.

The head holding member 41 is formed to a flat substantially rectangular parallelepiped box shape in which an upper surface is opened and the thickness in the vertical direction is thin. The outer shape of the head holding member 41 is smaller than the outer shape of the intermediate member 43. The head holding member 41 is placed on the upper surface of the bottom portion of the intermediate member 43. A fixing plate 22 to which the bottom surface of the head 3 is fixed is attached to the upper surface of the bottom portion of the head holding member 41. In the present embodiment, the fixing plate 22 is attached to the head holding member 41 so as to be turnable with respect to the head holding member 41 with the vertical direction as the axial direction of turn. That is, the head 3 is turnable with respect to the head holding member 41 with the vertical direction as the axial direction of turn.

The fixing plate 22 is placed on the upper surface of the bottom portion of the head holding member 41. A turning center shaft 56 serving as the turning center of the fixing plate 22 is fixed to the left back end of the head holding member 41. The turning center shaft 56 is disposed so that the axial direction of the turning center shaft 56 and the vertical direction coincide. The turning center shaft 56 is inserted through the fixing plate 22. The fixing plate 22 is pressed against the upper surface of the bottom portion of the head holding member 41 by a plurality of plate springs 57. More specifically, the fixing plate 22 is pressed against the upper surface of the bottom portion of the head holding member 41 by the one plate spring 57 disposed on the left back end side of the fixing plate 22, one plate spring 57 disposed on the left front end side of the fixing plate 22, and one plate spring 57 disposed on the right front end side of the fixing plate 22. One end of the plate spring 57 is fixed to the head holding member 41, and the other end of the plate spring 57 is brought into contact with the upper surface of the fixing plate 22.

The outer peripheral surface of an eccentric cam 58 for adjusting the turning angle of the fixing plate 22 with respect to the head holding member 41 is brought into contact with the front end of the left end face of the fixing plate 22. The eccentric cam 58 is attached to the head holding member 41 so as to be turnable with the vertical direction as the axial direction of turn. The fixing plate 22 is biased to the left side by the plate spring 59 held at the right end of the head holding member 41 and the front end of the left end face of the fixing plate 22 is brought into contact with the outer peripheral surface of the eccentric cam 58 at a predetermined contact pressure. The turning angle of the fixing plate 22 with respect to the head holding member 41 is adjusted by turning the eccentric cam 58.

Two plate springs 63 that bias the head holding member 41 toward the back side with respect to the intermediate member 43, and one plate spring 64 that biases the head holding member 41 toward the left side with respect to the intermediate member 43 are disposed between the head holding member 41 and the intermediate member 43. The plate spring 63 is in contact with the front end face of the head holding member 41, and the plate spring 64 is in contact with the right end face of the head holding member 41. The head holding member 41 is fixed to the intermediate member 43 in a state of being positioned with respect to the intermediate member 43 in the horizontal direction.

As with the head holding member 11, the head holding member 41 is formed with a contacting surface for positioning the head holding member 41 in the front and back direction, where the contacting surface and the positioning portion of the intermediate member 43 are in contact with each other at a predetermined contact pressure by the biasing force of the plate spring 63. The head holding member 41 is formed with a contacting surface for positioning the head holding member 41 in the left and right direction, where the contacting surface and the positioning portion of the intermediate member 43 are in contact with each other at a predetermined contact pressure by the biasing force of the plate spring 64. Similarly to the head holding member 11, an engagement portion for preventing lifting of the head holding member 41 is formed at the back end of the head holding member 41.

Similarly to the head holding member 11, the head holding member 41 is formed with an engagement portion 41*d* with which a part of the fixing lever 15 engages. The engagement portion 41*d* is formed at the front end of the head holding member 41. The engagement portion 41*d* is formed similarly to the engagement portion 11*d*, and a convex portion 41*e* similar to the convex portion 11*e* is formed on the upper surface of the engagement portion 41*d*. The fixing lever 15 is turnable between an engagement position 15A where the fixing lever 15 engages with the head holding member 41 to fix the head holding member 41 to the intermediate member 43, and a disengagement position 15B where the engagement state of the head holding member 41 and the fixing lever 15 is released and the head holding member 41 can be detached from the intermediate member 43.

Furthermore, when the fixing lever 15 is at the engagement position 15A, the convex portion 41*e* of the head holding member 41 is fitted to the concave portion 15*f* of the fixing lever 15. In the present embodiment, the fixing member holding mechanism that holds the fixing lever 15 at the engagement position 15A is configured by the convex portion 41*e*, the concave portion 15*f*, and the compression coil spring 29.

A head holding member 42 is configured similarly to the head holding member 41. The head holding member 42 is placed on the upper surface of the bottom portion of the base member 12. Furthermore, the head holding member 42 is disposed on the diagonally left back side of the intermediate member 43. Similarly to the head holding member 41, the fixing plate 22 is attached to the upper surface of the bottom portion of the head holding member 42 so as to be turnable with respect to the head holding member 42 with the vertical direction as the axial direction of turn. That is, the head 3 can be turned with respect to the head holding member 42 with the vertical direction as the axial direction of turn.

A turning center shaft 56 serving as the turning center of the fixing plate 22 is fixed to the back end of the head holding member 42. The fixing plate 22 is pressed against the upper surface of the bottom portion of the head holding member 42 by a plurality of plate springs 57. One end of the plate spring 57 is fixed to the head holding member 42, and the other end of the plate spring 57 is brought into contact with the upper surface of the fixing plate 22. The outer peripheral surface of an eccentric cam 58 for adjusting the turning angle of the fixing plate 22 with respect to the head holding member 42 is brought into contact with the front end of the left end face of the fixing plate 22. The eccentric cam 58 is attached to the head holding member 42 so as to be turnable with the vertical direction as the axial direction of turn. The fixing plate 22 is biased to the left side by the plate spring 59 held at the right end of the head holding member 42 and the front end of the left end face of the fixing plate 22 is brought into contact with the outer peripheral surface of the eccentric cam 58 at a predetermined contact pressure. The turning angle of the fixing plate 22 with respect to the head holding member 42 is adjusted by turning the eccentric cam 58.

Two plate springs 63 that bias the head holding member 42 toward the back side with respect to the base member 12, and one plate spring 64 that biases the head holding member 42 toward the left side with respect to the base member 12 are disposed between the head holding member 42 and the base member 12. The plate spring 63 is in contact with the front end face of the head holding member 42, and the plate spring 64 is in contact with the right end face of the head holding member 42. The head holding member 42 is fixed to the base member 12 in a state of being positioned with respect to the base member 12 in the horizontal direction.

As with the head holding member 41, the head holding member 42 is formed with a contacting surface for positioning the head holding member 42 in the front and back direction, where the contacting surface and the positioning portion formed in the base member 12 are in contact with each other at a predetermined contact pressure by the biasing force of the plate spring 63. The head holding member 42 is formed with a contacting surface for positioning the head holding member 42 in the left and right direction, where the contacting surface and the positioning portion formed in the base member 12 are in contact with each other at a predetermined contact pressure by the biasing force of the plate spring 64. Similarly to the head holding member 41, an engagement portion for preventing lifting of the head holding member 42 is formed at the back end of the head holding member 42. A protruding portion similar to the protruding portion 13*g* is formed on the base member 12, and the engagement portion of the head holding member 42 and the protruding portion of the base member 12 are engaged with each other.

The fixing lever 15 for fixing the head holding member 42 to the base member 12 is turnably attached to a lever attachment portion 12*c* of the base member 12. Similarly to the lever attachment portion 13*c* of the first embodiment, the lever attachment portion 12*c* includes a lever supporting protrusion formed to a cylindrical shape, and the fixing lever 15 is turnably attached to the lever attachment portion 12*c*, similarly to the first embodiment.

Similarly to the head holding member 41, the head holding member 42 is formed with an engagement portion 42*d* with which a part of the fixing lever 15 engages. The engagement portion 42*d* is formed at the front end of the head holding member 42. A convex portion 42*e* similar to the convex portion 41*e* is formed on the upper surface of the engagement portion 42*d*. The fixing lever 15 is turnable between an engagement position 15A where the fixing lever 15 engages with the head holding member 42 to fix the head holding member 42 to the base member 12, and a disengagement position 15B where the engagement state of the head holding member 42 and the fixing lever 15 is released and the head holding member 42 can be detached from the base member 12.

When the fixing lever 15 is at the engagement position 15A, the convex portion 42*e* of the head holding member 42 is fitted to the concave portion 15*f* of the fixing lever 15. In the present embodiment, the fixing member holding mechanism that holds the fixing lever 15 at the engagement position 15A is configured by the convex portion 42*e*, the concave portion 15*f*, and the compression coil spring 29.

When replacing the head 3 mounted on the carriage 4 and held by the head holding member 41 in the printer 1, first, the fixing lever 15 at the engagement position 15A is turned to the disengagement position 15B, and then the head holding member 41 holding the head 3 before replacement is moved toward the front side and detached from the intermediate member 43. Thereafter, the head holding member 41 holding the head 3 after replacement is moved toward the back side and attached to the intermediate member 43, and then the fixing lever 15 at the disengagement position 15B is turned to the engagement position 15A.

When replacing the head 3 mounted on the carriage 4 and held by the head holding member 42, first, the fixing lever 15 at the engagement position 15A is turned to the disengagement position 15B, and then the head holding member 42 holding the head 3 before replacement is moved toward the front side and detached from the base member 12. Thereafter, the head holding member 42 holding the head 3 after replacement is moved toward the back side and attached to the base member 12, and then the fixing lever 15 at the disengagement position 15B is turned to the engagement position 15A.

The present embodiment also has effects similar to those of the first embodiment. Furthermore, in the present embodiment, the relative position between the fixing lever 15 and the head holding member 41 does not change even if the head 3 is turned with respect to the head holding member 41. Therefore, in the present embodiment, even if the head 3 is turnable with respect to the head holding member 41, the head holding member 41 can be securely fixed to the intermediate member 43 by the fixing lever 15. Similarly, in the present embodiment, even if the head 3 is turned with respect to the head holding member 42, the relative position between the fixed lever 15 and the head holding member 42 does not change, and hence even if the head 3 is turnable with respect to the head holding member 42, the head holding member 42 can be securely fixed to the base member 12 by the fixing lever 15.

Other Embodiments

The above-described embodiments are examples of a preferred embodiment of the present disclosure, but the present disclosure is not limited thereto, and various modifications can be made without changing the gist of the present disclosure.

Figure 11A:
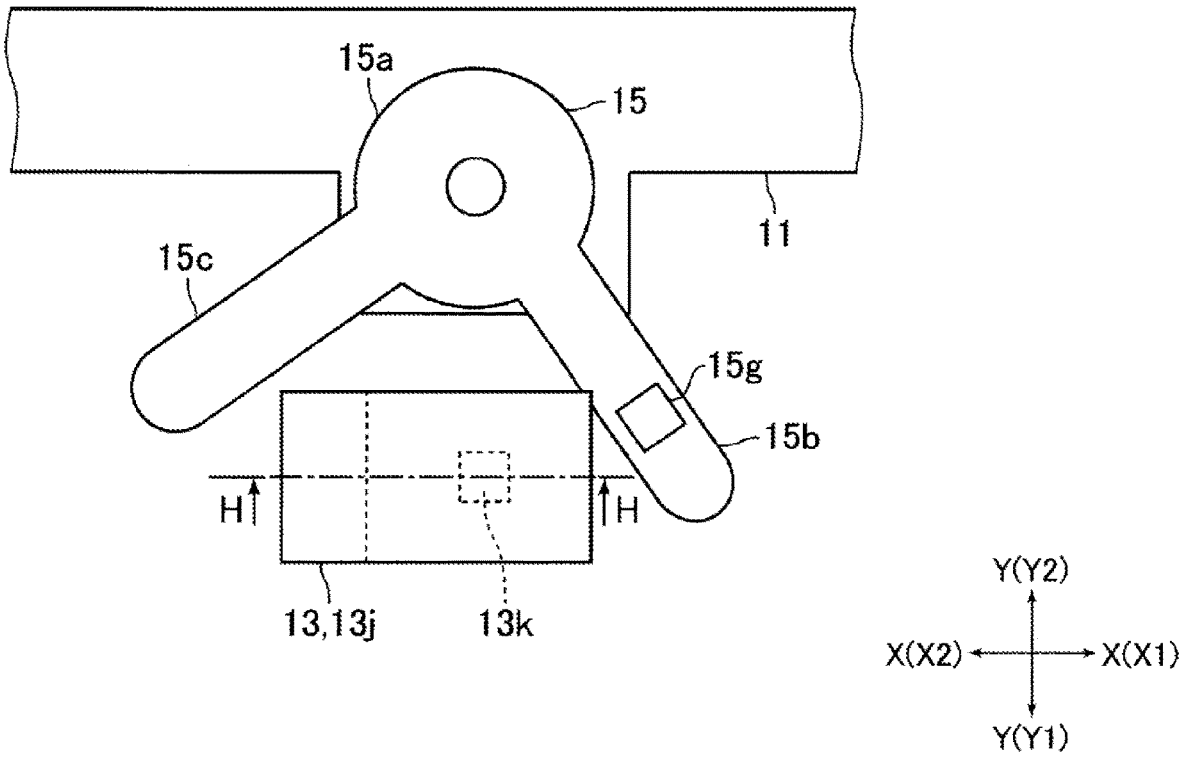
FIG. 11A is a plan view for explaining a configuration of a peripheral portion of a lever member according to another embodiment of the present disclosure.
Figure 11B:
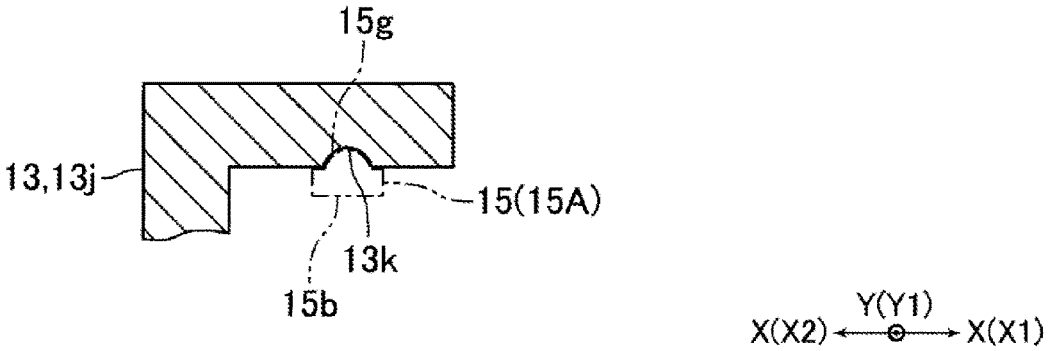
FIG. 11B is a cross-sectional view taken along line H-H in FIG. 11A.

In the first embodiment, as shown in FIG. 11A and FIG. 11B, the fixing lever 15 may be turnably held by the head holding member 11. In this case, the fixing lever 15 is turnable between an engagement position 15A where the fixing lever 15 engages with the intermediate member 13 to fix the head holding member 11 to the intermediate member 13, and a disengagement position 15B where the engagement state of the intermediate member 13 and the fixing lever 15 is released and the head holding member 11 can be detached from the intermediate member 13. However, when the fixing lever 15 is held by the intermediate member 13 as in the first embodiment, the fixing lever 15 does not need to be attached to each of the head holding members 11 to be detached from the intermediate member 13 together with the head 3. Therefore, in the first embodiment, the configuration of the member to be replaced together with the head 3 can be simplified.

In the modified example shown in FIG. 11A and FIG. 11B, for example, the intermediate member 13 is formed with an engagement portion 13*j* with which the engagement portion 15*b* of the fixing lever 15 engages. In this modified example, for example, a convex portion 15*g* for holding the fixing lever 15 at the engagement position 15A is formed on the upper surface of the engagement portion 15*b*, and a concave portion 13*k*, to which the convex portion 15*g* is fitted, is formed on the lower surface of the engagement portion 13*j*. Furthermore, when the fixing lever 15 is at the engagement position 15A, the engagement portion 15*b* is disposed on the lower side of the engagement portion 13*j*, and the convex portion 15*g* is fitted to the concave portion 13*k*. Furthermore, the fixing lever 15 is biased toward the upper side by, for example, a spring member such as a compression coil spring. In this case, the fixing member holding mechanism that holds the fixing lever 15 at the engagement position 15A is configured by the spring member that biases the fixing lever 15, the concave portion 13*k*, and the convex portion 15*g*. FIG. 11B is a cross-sectional view taken along the line H-H in FIG. 11A.

Similarly, in the second embodiment, the fixing lever 15 for fixing the head holding member 41 to the intermediate member 43 may be turnably held by the head holding member 41, and may be turnable between the engagement position 15A where the fixing lever 15 engages with the intermediate member 43 to fix the head holding member 41 to the intermediate member 43, and the disengagement position 15B where the engagement state of the intermediate member 43 and the fixing lever 15 is released and the head holding member 41 can be detached from the intermediate member 43.

Furthermore, in the second embodiment, the fixing lever 15 for fixing the head holding member 42 to the base member 12 may be turnably held by the head holding member 42, and may be turnable between the engagement position 15A where the fixing lever 15 engages with the base member 12 to fix the head holding member 42 to the base member 12, and the disengagement position 15B where the engagement state of the base member 12 and the fixing lever 15 is released and the head holding member 42 can be detached from the base member 12.

In the first embodiment, a fixing member for fixing the head holding member 11 to the intermediate member 13 may be held by the intermediate member 13 in place of the fixing lever 15 in such a way that a linear movement or a curved movement in the horizontal direction or the vertical direction can be performed. In other words, a fixing member for fixing the head holding member 11 to the intermediate member 13 may be slidably held by the intermediate member 13. In this case, the fixing member is slidable between an engagement position where the fixing member engages with the head holding member 11 to fix the head holding member 11 to the intermediate member 13, and a disengagement position where the engagement state of the head holding member 11 and the fixing member is released and the head holding member 11 can be detached from the intermediate member 13.

However, when the fixing lever 15 is turnably held by the intermediate member 13 as in the first embodiment, a movable region of the fixing lever 15 can be narrowed compared to a case where the fixing member slides between the engagement position and the disengagement position. Therefore, the head holding mechanism 8 can be miniaturized.

Similarly, in the second embodiment, in place of the fixing lever 15, a fixing member for fixing the head holding member 41 to the intermediate member 43 may be slidably held by the intermediate member 43. In this case, the fixing member is slidable between an engagement position where the fixing member engages with the head holding member 41 to fix the head holding member 41 to the intermediate member 43, and a disengagement position where the engagement state of the head holding member 41 and the fixing member is released and the head holding member 41 can be detached from the intermediate member 43.

Moreover, in the second embodiment, in place of the fixing lever 15, a fixing member for fixing the head holding member 42 to the base member 12 may be slidably held by the base member 12. In this case, the fixing member is slidable between an engagement position where the fixing member engages with the head holding member 42 to fix the head holding member 42 to the base member 12, and a disengagement position where the engagement state of the head holding member 42 and the fixing member is released and the head holding member 42 can be detached from the base member 12.

In the second embodiment, the fixing plate 22 may be attached to the head holding member 41 so as to be linearly movable in the front and back direction with respect to the head holding member 41. That is, the head 3 may be linearly movable in the front and back direction with respect to the head holding member 41. In this case, the intermediate member 43 is attached to the base member 12 so as to be turnable with respect to the base member 12 with the vertical direction as the axial direction of turn. Furthermore, in the second embodiment, the head 3 may be linearly movable in the front and back direction with respect to the head holding member 42. Moreover, in the first embodiment, the head 3 may be linearly movable in the front and back direction with respect to the head holding member 11. In addition, in the first embodiment, three or more heads 3 may be fixed to the head holding member 11 in a state where the respective positions are adjusted in the front and back direction and in the left and right direction.

What is claimed is:

1. A head holding mechanism that holds an inkjet head mounted on a carriage, the head holding mechanism comprising:

a head holding member, being configured to hold the inkjet head;

a carriage side member, being attached to the carriage and to which the head holding member is fixed; and a fixing member, being configured to fix the head holding member to the carriage side member, wherein the fixing member is movably held by one of the head holding member and the carriage side member, and the fixing member is movable between an engagement position and a disengagement position, the engagement position is a position where the fixing member engages with the other one of the head holding member and the carriage side member, so as to fix the head holding member to the carriage side member, and the disengagement position is a position where an engagement state of the other one of the head holding member and the carriage side member and the fixing member is released, and the head holding member is detachable from the carriage side member, wherein the carriage side member comprises:

a first carriage side member, being fixed to the carriage; and a second carriage side member, to which the head holding member is fixed by the fixing member, wherein a position of the second carriage side member is capable of being adjusted with respect to the first carriage side member while the fixing member is at the engagement position.

2. The head holding mechanism according to claim 1, wherein the fixing member is turnable between the engagement position and the disengagement position with a vertical direction as an axial direction of turn.

3. The head holding mechanism according to claim 2, wherein the fixing member is movably held by the carriage side member and engages with the head holding member at the engagement position.

4. The head holding mechanism according to claim 3, wherein the carriage side member comprises:

a first carriage side member, being fixed to the carriage; and a second carriage side member, being movably attached to the first carriage side member and to which the head holding member is fixed, wherein the second carriage side member is turnable with respect to the first carriage side member with the vertical direction as the axial direction of turn or is linearly movable in a main scanning direction, which is a moving direction of the carriage, and a sub scanning direction, which is orthogonal to the vertical direction, with respect to the first carriage side member, and the fixing member is movably held by one of the head holding member and the second carriage side member.

5. The head holding mechanism according to claim 2, wherein the carriage side member comprises:

a first carriage side member, being fixed to the carriage; and a second carriage side member, being movably attached to the first carriage side member and to which the head holding member is fixed, wherein the second carriage side member is turnable with respect to the first carriage side member with the vertical direction as the axial direction of turn or is linearly movable in a main scanning direction, which is a moving direction of the carriage, and a sub scanning direction, which is orthogonal to the vertical direction, with respect to the first carriage side member, and the fixing member is movably held by one of the head holding member and the second carriage side member.

6. The head holding mechanism according to claim 1, wherein the fixing member is movably held by the carriage side member and engages with the head holding member at the engagement position.

7. The head holding mechanism according to claim 6, wherein the carriage side member comprises:

a first carriage side member, being fixed to the carriage; and a second carriage side member, being movably attached to the first carriage side member and to which the head holding member is fixed, wherein the second carriage side member is turnable with respect to the first carriage side member with the vertical direction as an axial direction of turn or is linearly movable in a main scanning direction, which is a moving direction of the carriage, and a sub scanning direction, which is orthogonal to the vertical direction, with respect to the first carriage side member, and the fixing member is movably held by one of the head holding member and the second carriage side member.

8. The head holding mechanism according to claim 1, wherein the inkjet head is turnable with respect to the head holding member with the vertical direction as an axial direction of turn, or is linearly movable in a main scanning direction, which is a moving direction of the carriage, and a sub scanning direction, which is orthogonal to the vertical direction, with respect to the head holding member.

9. The head holding mechanism according to claim 1, further comprising:

a fixing member holding mechanism that holds the fixing member at the engagement position.

10. An inkjet printer, comprising:

the head holding mechanism according to claim 1;

the inkjet head; and the carriage, wherein printing is carried out on a medium.

11. A head holding mechanism that holds an inkjet head mounted on a carriage, the head holding mechanism comprising:

a head holding member, being configured to hold the inkjet head;

a carriage side member, being attached to the carriage and to which the head holding member is fixed; and a fixing member, being configured to fix the head holding member to the carriage side member, wherein the fixing member is movably held by one of the head holding member and the carriage side member, and the fixing member is movable between an engagement position and a disengagement position, the engagement position is a position where the fixing member engages with the other one of the head holding member and the carriage side member, so as to fix the head holding member to the carriage side member, and the disengagement position is a position where an engagement state of the other one of the head holding member and the carriage side member and the fixing member is released, and the head holding member is detachable from the carriage side member, wherein the carriage side member comprises:

a first carriage side member, being fixed to the carriage; and a second carriage side member, being movably attached to the first carriage side member and to which the head holding member is fixed, wherein the second carriage side member is turnable with respect to the first carriage side member with the vertical direction as an axial direction of turn or is linearly movable in a main scanning direction, which is a moving direction of the carriage, and a sub scanning direction, which is orthogonal to the vertical direction, with respect to the first carriage side member, and the fixing member is movably held by one of the head holding member and the second carriage side member.

12. The head holding mechanism according to claim 11, wherein the head holding member is fixed to the second carriage side member in a state of being positioned with respect to the second carriage side member in a horizontal direction.

* * * * *